US010980289B2

(12) United States Patent
Ng

(10) Patent No.: US 10,980,289 B2
(45) Date of Patent: Apr. 20, 2021

(54) BOXER BRIEFS

(71) Applicant: Oriya Ng, Surrey (CA)

(72) Inventor: Oriya Ng, Surrey (CA)

( * ) Notice: Subject to any disclaimer, the term of this patent is extended or adjusted under 35 U.S.C. 154(b) by 0 days.

(21) Appl. No.: 15/277,556

(22) Filed: Sep. 27, 2016

(65) Prior Publication Data

US 2018/0084837 A1 Mar. 29, 2018

(51) Int. Cl.
*A41B 9/02* (2006.01)

(52) U.S. Cl.
CPC ..... *A41B 9/023* (2013.01); *A41B 2400/20* (2013.01); *A41B 2400/22* (2013.01); *A41B 2400/34* (2013.01); *A41B 2400/60* (2013.01)

(58) Field of Classification Search
CPC .. A41B 9/00; A41B 9/02; A41B 9/023; A41B 9/026; A41B 2400/20; A41B 2400/22; A41B 2400/34; A41B 2400/36; A41B 2400/60
USPC ..... 2/400, 401, 403, 404, 405
See application file for complete search history.

(56) References Cited

U.S. PATENT DOCUMENTS 2,058,970 A * 10/1936 Fiesh ..... A41B 9/02 602/67
4,173,976 A * 11/1979 Bloomquist ..... A41B 9/02 2/403
4,244,059 A * 1/1981 Pflaumer ..... A41B 9/004 2/400
4,326,302 A * 4/1982 Lowe ..... A61F 5/4401 2/405
4,961,419 A * 10/1990 Tribble ..... A41B 9/023 2/403
5,081,716 A * 1/1992 Lehenbauer ..... A41B 9/00 2/109
5,210,882 A * 5/1993 Moretz ..... A41B 9/004 2/400
5,226,179 A * 7/1993 Choi ..... A41B 9/023 2/403
5,414,870 A * 5/1995 Moretz ..... A41B 9/02 2/400
5,435,014 A * 7/1995 Moretz ..... A41B 9/02 2/400
5,870,779 A * 2/1999 Heron ..... A41B 9/023 2/400
5,984,910 A * 11/1999 Berke ..... A41B 9/023 128/854
6,061,839 A * 5/2000 Smolik ..... A61F 13/471 2/400
6,245,036 B1 * 6/2001 McRoberts ..... A61F 5/40 2/403
6,289,520 B1 9/2001 Page
6,662,378 B2 * 12/2003 Vartanyan ..... A41B 9/02 2/400
7,043,771 B1 5/2006 Alessi
7,065,797 B1 6/2006 Chen
7,178,174 B2 * 2/2007 Soderstrom ..... A41B 9/02 2/403

(Continued)

*Primary Examiner* — Jocelyn Bravo
(74) *Attorney, Agent, or Firm* — Argus Intellectual Enterprise; Daniel Enea; Jordan Sworen

(57) ABSTRACT

An article of clothing for wear under a pair of trousers or the like, the article of clothing including a loose fit boxer underwear structure and a support structure nested within the boxer underwear structure. The support structure includes a pouch for supporting male genitals.

11 Claims, 5 Drawing Sheets

(56) References Cited

U.S. PATENT DOCUMENTS 7,434,273 B2 * 10/2008 Chung ..... A41B 9/023 2/403
7,669,253 B2 * 3/2010 Lin ..... A41B 9/023 2/400
7,676,853 B1 * 3/2010 Cutlip ..... A41B 9/023 2/403
7,958,571 B2 6/2011 Kitsch
D651,378 S * 1/2012 Cho ..... D2/712
8,332,968 B1 * 12/2012 Williams ..... A41B 9/02 2/238
8,361,049 B2 * 1/2013 Coenen ..... A41B 9/001 604/394
8,499,364 B2 * 8/2013 Dye ..... A41B 9/002 2/400
9,198,807 B2 * 12/2015 Evenson ..... A61F 13/49006
9,629,400 B2 * 4/2017 Landi ..... A41D 13/0575
9,687,030 B2 * 6/2017 Bigney ..... A41B 9/023
2005/0229293 A1 * 10/2005 Miller ..... A41B 9/02 2/403
2005/0268380 A1 * 12/2005 Sovell ..... A41B 9/023 2/400
2005/0278820 A1 * 12/2005 Newman ..... A41B 9/00 2/69
2006/0005301 A1 * 1/2006 Taylor ..... A41B 9/02 2/403
2006/0206993 A1 * 9/2006 Bonnin ..... A41B 9/02 2/400
2007/0180601 A1 * 8/2007 Chou ..... A41B 9/02 2/403
2007/0220661 A1 * 9/2007 Blohmann ..... A41B 9/023 2/404
2007/0245463 A1 * 10/2007 Kang ..... A41B 9/023 2/403
2007/0277285 A1 * 12/2007 Gravette ..... A41B 9/023 2/78.1
2007/0283484 A1 * 12/2007 Wright ..... A41B 9/02 2/404
2008/0052807 A1 * 3/2008 Lai ..... A41B 9/023 2/405
2008/0109945 A1 * 5/2008 Xia ..... A41B 9/023 2/403
2008/0178369 A1 * 7/2008 Kitsch ..... A41B 9/023 2/405
2009/0106874 A1 * 4/2009 Shlush ..... A41B 9/12 2/78.1
2009/0320184 A1 * 12/2009 Schaefer ..... A41B 9/02 2/405
2010/0275349 A1 * 11/2010 Wilson, II ..... A41D 13/0506 2/466
2012/0023631 A1 * 2/2012 Fischer ..... A41D 13/012 2/2.15
2012/0255102 A1 * 10/2012 Soderstrom ..... A41B 9/023 2/403
2012/0255103 A1 * 10/2012 Evenstad ..... A41B 9/02 2/405
2012/0260404 A1 * 10/2012 Steele ..... A41B 9/023 2/404
2013/0061858 A1 * 3/2013 Saeteurn ..... A61F 13/496 128/891
2013/0104293 A1 * 5/2013 Gu ..... A41B 9/023 2/404
2013/0219591 A1 * 8/2013 Gu ..... A41B 9/002 2/405
2014/0047620 A1 * 2/2014 Ingalls ..... A41B 9/02 2/403
2014/0237704 A1 * 8/2014 Mehrabian ..... A41B 9/023 2/404
2014/0289935 A1 * 10/2014 Astin ..... A41B 9/026 2/403
2015/0181947 A1 * 7/2015 Back ..... A61F 13/505 2/400
2016/0073697 A1 * 3/2016 Nezat ..... A41B 17/00 2/113
2016/0157531 A1 * 6/2016 Fisher ..... A41D 1/088 2/403
2016/0258086 A1 * 9/2016 Turner ..... A41D 1/08
2016/0278438 A1 * 9/2016 Polidan ..... A41B 9/023

* cited by examiner

BOXER BRIEFS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of undergarments and more specifically relates to boxer briefs for wear under a pair of trousers.

2. Description of Related Art

Undergarments are items of clothing worn beneath outer clothes, usually in direct contact with the skin, although they may comprise more than a single layer. They serve to keep outer garments from being soiled or damaged by bodily excretions, to lessen the friction of outerwear against the skin, to shape the body, and to provide concealment or support for parts of it. In cold weather, long underwear is sometimes worn to provide additional warmth. Special types of undergarments have religious significance. Some items of clothing are designed as undergarments, while others, such as T-shirts and certain types of shorts, are appropriate both as undergarments and as outer clothing. If made of suitable material or textile, some undergarments can serve as nightwear or swimsuits, and some are intended for sexual attraction or visual appeal.

Undergarments are generally of two types, those that are worn to cover the torso and those that are worn to cover the waist and legs, although there are also garments which cover both. Different styles of undergarments are generally worn by females and males. Undergarments commonly worn by females today include bras and panties, while males often wear briefs, boxer briefs or boxer shorts. The problem with current undergarments on the market is that they do not provide sufficient comfort and support of male genitals. A suitable solution is desired.

Several attempts have been made to solve the above-mentioned problems such as those found in U.S. Pub. No. 2005/0268380 to Gregory Sovell; 2013/0061858 to Sou Fou Saeteurn; 2007/0245463 to Paul Kang, U.S. Pat. No. 7,958,571 to William Trent Kitsch; U.S. Pat. No. 6,289,520 to Bradley N. Page; U.S. Pat. No. 7,043,771 to Brian J. Alessi; U.S. Pat. No. 7,065,797 to Shyan-Wei Chen; and U.S. Pat. No. 5,210,882 to Herbert L. Moretz. This art is representative of undergarments. However, none of the above inventions and patents, taken either singly or in combination, is seen to describe the invention as claimed.

Preferably, an undergarment should provide comfort and support for male genitals and, yet would operate reliably and be manufactured at a modest expense. Thus, a need exists for a reliable boxer brief for wear under a pair of trousers to avoid the above-mentioned problems.

BRIEF SUMMARY OF THE INVENTION

In view of the foregoing disadvantages inherent in the known undergarment art, the present invention provides a novel undergarment. The general purpose of the present invention, which will be described subsequently in greater detail is to provide a boxer brief for wear under a pair of trousers.

An article of clothing for wear under a pair of trousers or the like is disclosed herein. The article of clothing includes a loose fit boxer underwear structure and a support structure within the boxer underwear structure. The boxer underwear structure has a plurality of panels including a gusset panel, said plurality of panels joined at seams, the boxer underwear structure further including a waistband, an outer fly opening, a waist opening, a left leg opening, and a right leg opening; the boxer underwear structure configured to conform to a human body between a waist and an upper portion of a left leg and an upper portion of a right leg; the boxer underwear structure defining a boxer-body between the waist opening and the left leg opening, and the right leg opening. The boxer underwear structure has a front, a rear, a left side, a right side, an interior side, and an exterior side. A support structure is within the boxer underwear structure; the support structure including a pouch configured to support a pair of testicles and having an inner fly opening; the pouch fixed to a gusset seam at the rear of the boxer underwear structure and extending forward and upward to the waistband. The support structure is further fixed to a waistband seam.

The support structure preferably includes a mesh material. The mesh material may comprise a four-way-stretch-nylon-fabric which is flexible and configured to provide compressive support for male genitals. The four-way-stretch-nylon-fabric has moisture wicking properties. Further, the four-way-stretch-nylon-fabric is breathable and is configured to provide ventilation between opposing sides of the four-way-stretch-nylon-fabric. The pouch is configured to secure and support the pair of testicles, and further configured to catch a penis of a user-wearer from contacting legs of the user-wearer when worn by the user-wearer. The pouch is configured to reduce friction between the penis and the legs of the user-wearer and to mitigate skin infection including tinea cruris.

The pouch includes anti-bacterial features configured for improved hygiene and odor protection. The boxer underwear structure is arranged as a boxer short; the boxer short having a loose fit body configured to loosely contour to the human body between the waist and the upper portion of the left leg and the upper portion of the right leg. The pouch is suspended and nested within the boxer underwear structure, and the support structure is further fixed to a waistband seam and to a fly seam of the outer fly opening. The waistband includes an elastic material configured to contour to a waist of the human body. The pouch is sewn on an interior side of the outer fly opening along a seam of the outer fly opening. The pouch is configured to be at least partially suspended above the gusset panel when worn by a user-wearer. The boxer underwear structure is arranged as a boxer brief; the boxer short having a body form fit body configured to closely contour to the human body between the waist and the upper portion of the left leg and the upper portion of the right leg.

According to another embodiment, a method for manufacture is also disclosed herein. The method includes step one, joining a left and right front panel crotch seam; step two, joining a back panel rise seam; step three, assembling a mesh panel; step four, attaching the mesh panel on a front panel fly opening; and step five, joining the mesh panel, a rear seam, and back panels to side seams.

BRIEF DESCRIPTION OF THE DRAWINGS

The figures which accompany the written portion of this specification illustrate embodiments and method(s) of use for the present disclosure, article of clothing, boxer briefs (boxer brief system), constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an undergarment and more particularly to a boxer briefs as used to improve the comfort and support of male undergarments for wear under trousers. The features of the invention which are believed to be novel are particularly pointed out and distinctly claimed in the concluding portion of the specification. These and other features, aspects, and advantages of the present invention will become better understood with reference to the following drawings and

DETAILED DESCRIPTION

Generally, a loose fit boxer is disclosed herein comprising an auxiliary supportive crotch pouch, in particular, the kind of looser fit boxer with a supportive pouch design to secure the penis and reduce direct contact between the penis and the legs, to prevent friction and the occurrence of tinea cruris and other skin infections.

The loose fit boxer comprises an auxiliary supportive crotch pouch. One end of the pouch is attached to the center seam of the crotch or its nearby place and the other end of the pouch is attached to a waistband, waist belt, elastic cord or its nearby place. The pouch secures and protects the penis and supports the weight of the testicles so that the penis does not slant or dangle loosely. The present invention also prevents contact between the penis and the crotch, thereby reducing friction and preventing the occurrence of tinea cruris.

Figure 1:
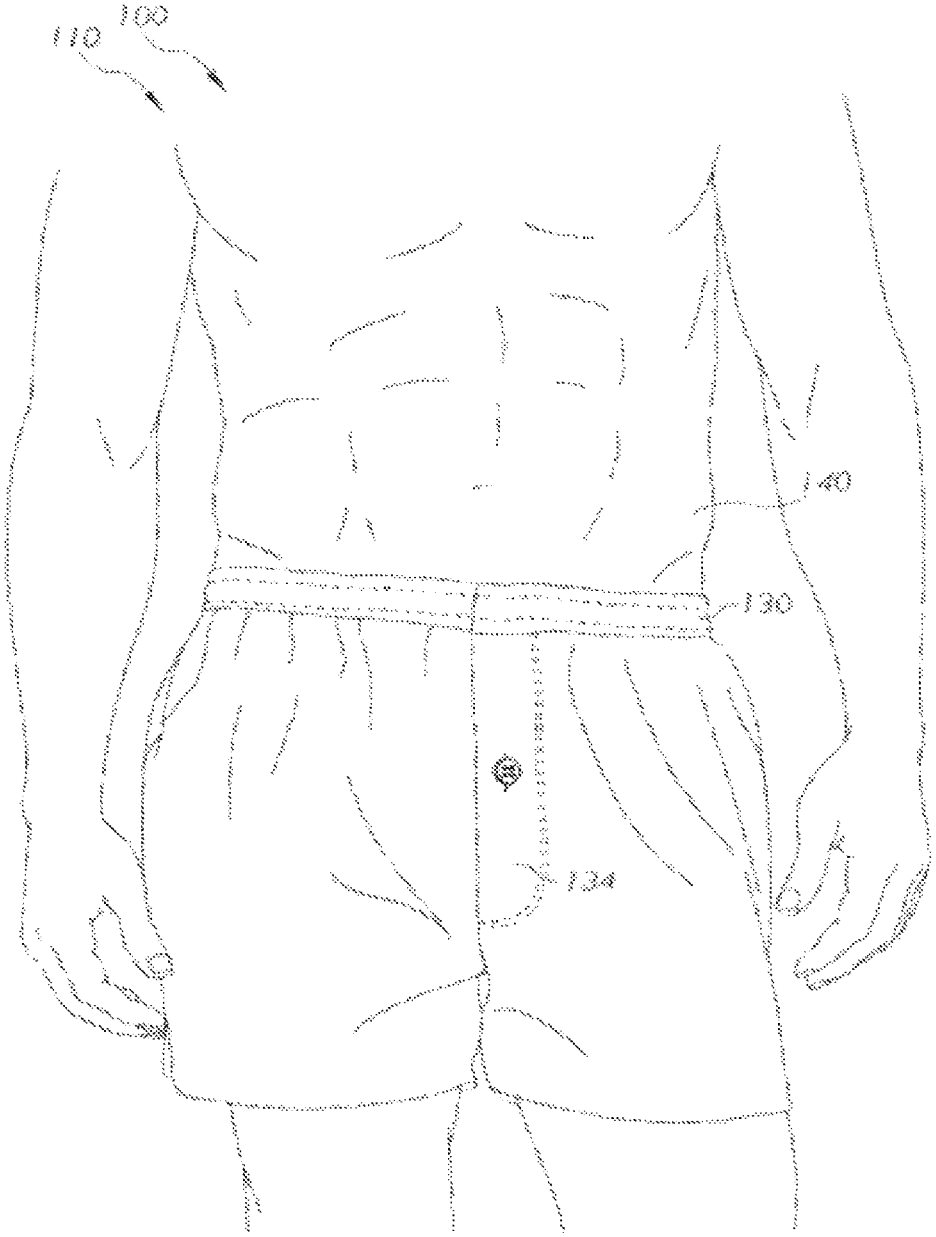
FIG. 1 shows a perspective view illustrating a boxer briefs during an 'in-use' condition showing a boxer underwear structure according to one exemplary embodiment.

Referring to the drawings by numerals of reference there is shown in FIG. 1, article of clothing 100 for wear under a pair of trousers or the like. The article of clothing 100 includes boxer underwear structure 110 and support structure 160 within the boxer underwear structure 110. The boxer underwear structure 110 has a plurality of panels 120 including gusset panel 124, plurality of panels 120 joined at seams, boxer underwear structure 110 further including waistband 130, outer fly opening 134, waist opening 136, left leg opening 138, and right leg opening 142; boxer underwear structure 110 configured to conform to a human body between a waist and an upper portion of a left leg and an upper portion of a right leg. Boxer underwear structure 110 defines boxer-body 144 between waist opening 136 and left leg opening 138, and right leg opening 142, boxer underwear structure 110 having a front, a rear, a left side, a right side, an interior side, and an exterior side. Support structure 160 is within boxer underwear structure 110, support structure 160 including pouch 162 configured to support a pair of testicles and having inner fly opening 164, pouch 162 fixed to gusset seam 166 at the rear of boxer underwear structure 110 and extending forward and upward to waistband 130, support structure 160 further fixed to waistband seam.

Figure 2:
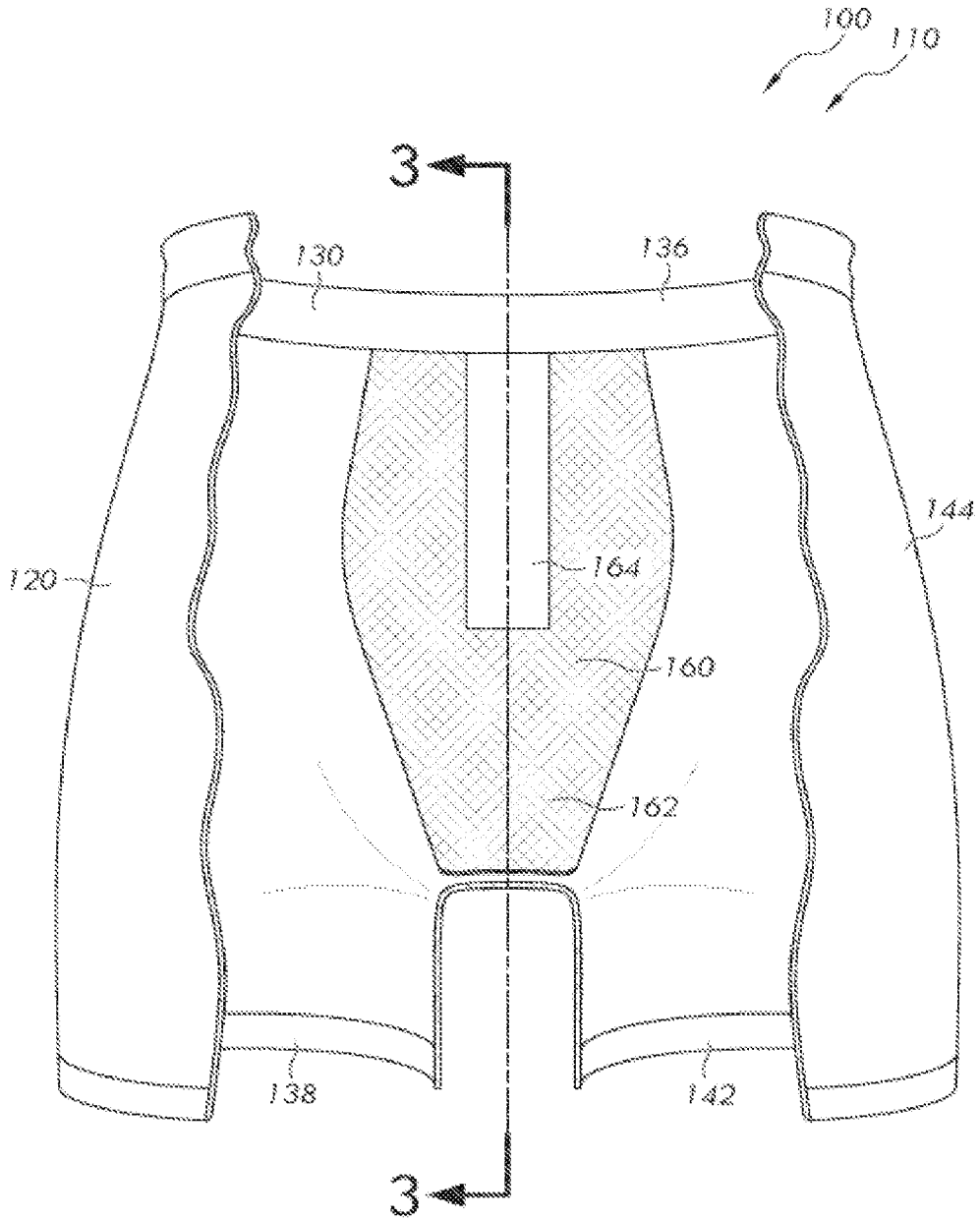
FIG. 2 is a cutaway view illustrating an interior of the boxer underwear structure of the boxer briefs of FIG. 1.

Referring now to FIG. 2 showing article of clothing 100 for wear under a pair of trousers or the like. Support structure 160 includes a mesh material. The mesh material is a four-way-stretch-nylon-fabric which is flexible and configured to provide compressive support for male genitals. The four-way-stretch-nylon-fabric has moisture wicking properties. Further, the four-way-stretch-nylon-fabric is breathable and is configured to provide ventilation between opposing sides of the four-way-stretch-nylon-fabric. Pouch 162 is configured to secure and support the pair of testicles, and further configured to catch a penis of a user-wearer from contacting legs of user-wearer 140 when worn by user-wearer 140. Pouch 162 is configured to reduce friction between the penis and the legs of user-wearer 140 and to mitigate skin infection including tinea cruris.

Figure 3:
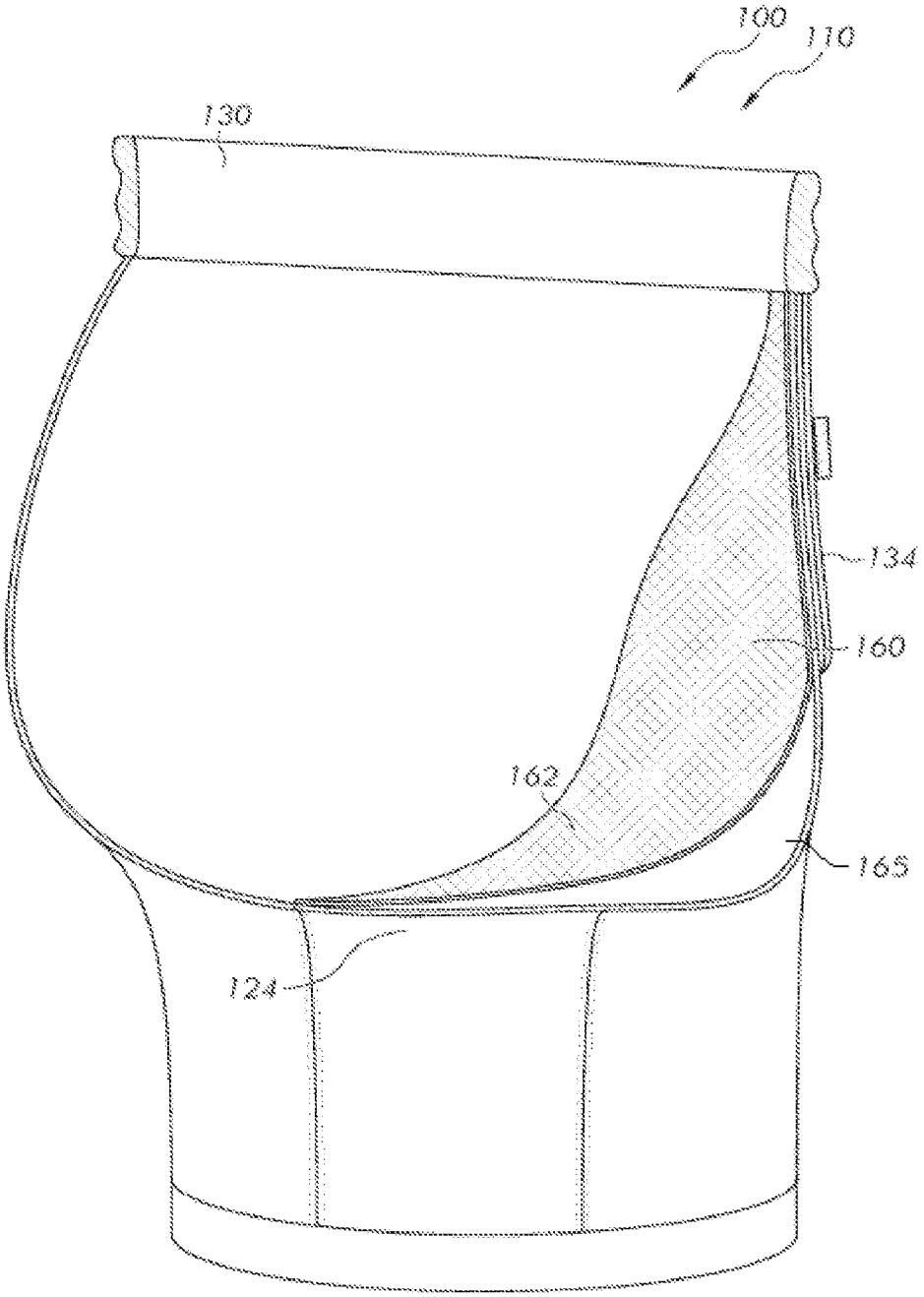
FIG. 3 is a side view illustrating the boxer underwear structure having a pouch according to an embodiment of the present disclosure.

Referring now to FIG. 3, pouch 162 including anti-bacterial features is configured for improved hygiene and odor protection. Boxer underwear structure 110 is arranged as a boxer short; the boxer short having a loose fit body configured to loosely contour to the human body between the waist and the upper portion of the left leg and the upper portion of the right leg.

In one embodiment, the pouch 162 is positioned inside the boxer underwear structure 110 when in the in-use configuration, such that a gap 165 is formed between the pouch 162 and a front panel of the plurality of panels 120.

Figure 4:
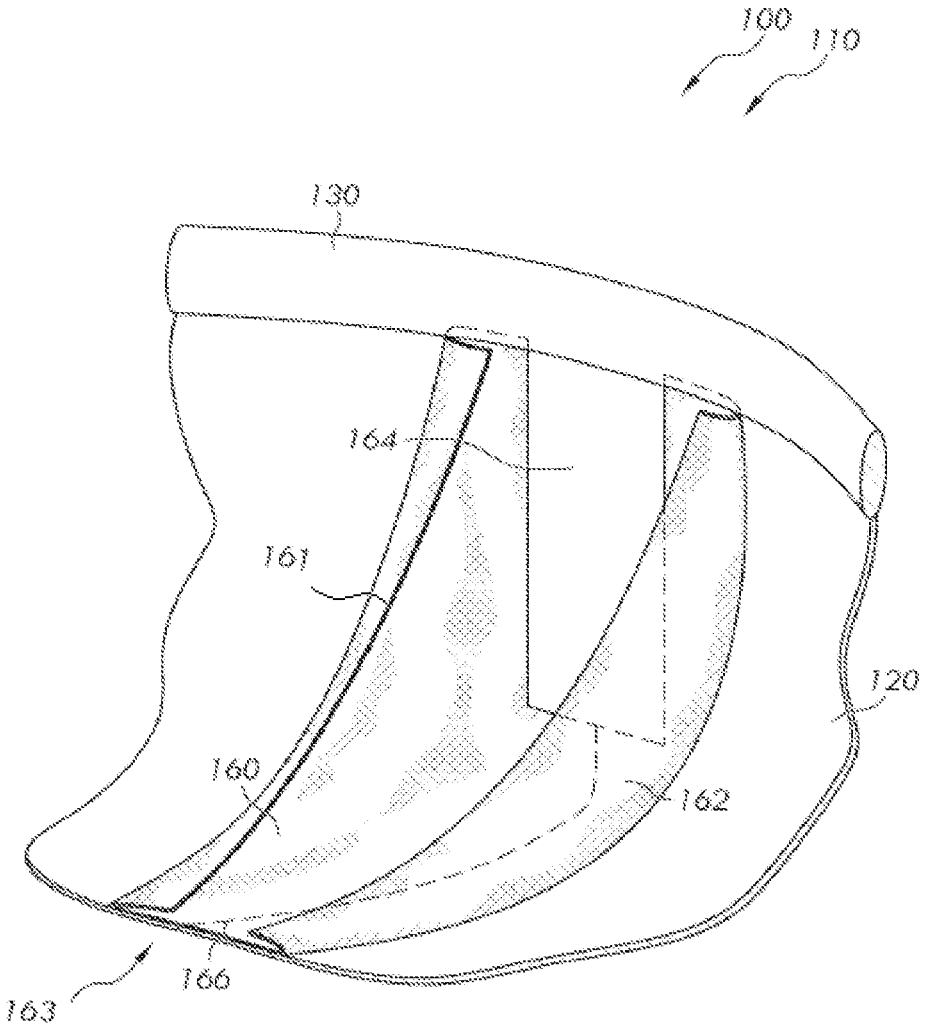
FIG. 4 is a interior view illustrating the pouch of the boxer underwear structure according to an embodiment of the present disclosure.

Referring now to FIG. 4, pouch 162 is suspended and nested within boxer underwear structure 110, and support structure 160 is further fixed to a waistband seam and to a fly seam of the outer fly opening. Waistband 130 includes an elastic material configured to contour to a waist of the human body. Pouch 162 is sewn on an interior side of outer fly opening 134 along a seam of outer fly opening 134. Pouch 162 is configured to be at least partially suspended above gusset panel 124 when worn by user-wearer 140. Boxer underwear structure 110 is arranged as a boxer brief, the boxer briefs having a body form fit body configured to closely contour to the human body between the waist and the upper portion of the left leg and the upper portion of the right leg.

In one embodiment, the pouch 162 comprises a pair of lateral support sections 161 that curve from a central portion, wherein the lateral support sections 161 are entirely continuous and coextensive with the central portion. The lateral support sections 161 extend along a width of the pouch 162 and fold inwards such that each lateral support section 162 has a free center-facing edge.

In the shown embodiment, the support structure 160 is generally above an uppermost portion of the gusset panel 166. The support structure 160 includes an open rear side 163 such that the support structure 160 terminates at the open rear side 163.

Boxer briefs 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, and technological advances, etc.

Figure 5:
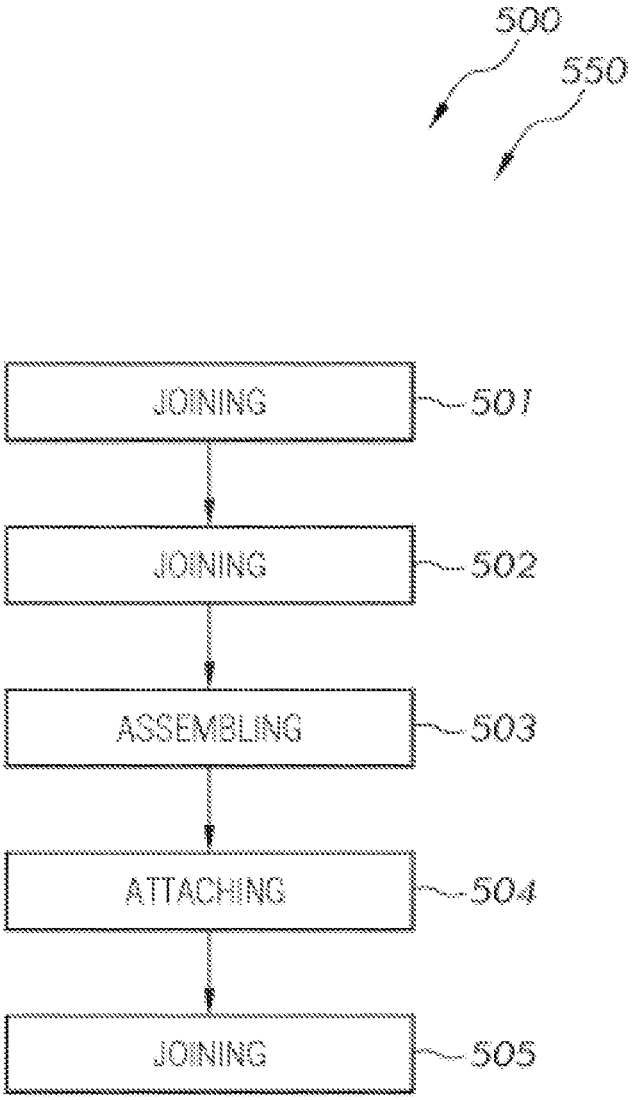
FIG. 5 is a flow diagram illustrating a method of manufacture for boxer briefs according to an embodiment of the present disclosure.

Referring now to FIG. 5 showing a flow diagram 550 illustrating method of manufacture 500 for boxer briefs 100 according to an embodiment of the present invention of FIGS. 1-4. As shown, method of manufacture 500 may comprise the steps of: step one 501, joining a left and right front panel crotch seam; step two 502, joining a back panel rise seam; step three 503, assembling a mesh panel; step four 504, attaching the mesh panel on a front panel fly opening; step five 505, joining the mesh panel, a rear seam, and back panels to side seams.

It should be noted that the steps described in the method of use can be carried out in many different orders according to user preference. The use of "step of" should not be interpreted as "step for", in the claims herein and is not intended to invoke the provisions of 35 U.S.C. § 112(f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The present disclosure may provide for significant improvements and serve as boxer briefs. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

The embodiments of the invention described herein are exemplary and numerous modifications, variations and rearrangements can be readily envisioned to achieve substantially equivalent results, all of which are intended to be embraced within the spirit and scope of the invention. For purposes of summarizing the disclosure, certain aspects, advantages, and novel features of the invention have been described herein. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An article of clothing for providing genital support, comprising:

a boxer underwear structure including a plurality of panels including a gusset panel, the plurality of panels joined at seams, the boxer underwear structure further including a waistband, a waist opening, a left leg opening, and a right leg opening, the boxer underwear structure having a front, a rear, a left side, a right side, an interior side, and an exterior side;

a support structure within the boxer underwear structure, the support structure including a pouch adapted to cover and support a pair of testicles of a user-wearer, the pouch fixed to a gusset seam at the rear of the boxer underwear structure and extending forward and upward to the waist opening, wherein the support structure is further directly fixed to the waistband and suspended from the waistband;

wherein the pouch is configured to reduce friction between the pair of testicles and a leg of the user-wearer by separating and suspending the pair of testicles above the gusset panel in an in-use configuration;

wherein the pouch is positioned inside the boxer underwear structure when in the in-use configuration such that a gap is formed between the pouch and a front panel of the plurality of panels;

wherein the pouch comprises a central portion that extends along the gusset seam, and a pair of lateral support sections that curve outwardly from the central portion, wherein the lateral support sections are entirely continuous and coextensive with the central portion;

wherein the lateral support sections extend along a width of the pouch and fold inwards such that each lateral support section has a free and unattached center-facing edge;

wherein the support structure is generally above an uppermost portion of the gusset panel; and wherein the support structure includes an open rear side and the support structure terminates at the open rear side.

2. The article of clothing of claim 1, wherein the pouch further comprises: an inner fly opening adapted to provide access to an outer fly opening of the boxer underwear structure.

3. The article of clothing of claim 2, wherein the pouch is sewn on an interior side of the outer fly opening.

4. The article of clothing of claim 1, wherein the support structure includes a mesh material.

5. The article of clothing of claim 4, wherein the mesh material is a four-way-stretch-nylon-fabric, wherein the four-way-stretch-nylon-fabric is flexible and is adapted to provide compressive support for male genitals.

6. The article of clothing of claim 1, wherein the support structure includes moisture wicking properties.

7. The article of clothing of claim 1, wherein the support structure is breathable and is adapted to provide ventilation between opposing sides of the support structure.

8. The article of clothing of claim 1, wherein the pouch includes anti-bacterial features.

9. The article of clothing of claim 1, wherein the boxer underwear structure is arranged as a boxer short, such that the boxer underwear structure is adapted to loosely contour to the user-wearer between the waist opening, the left leg opening, and the right leg opening.

10. The article of clothing of claim 1, wherein the waistband includes an elastic material adapted to contour to a waist of the user-wearer.

11. The article of clothing of claim 1, wherein the support structure is only attached at the gusset seam and at the waistband, such that the pouch is not secured to the left side or to the right side of the boxer underwear structure.

* * * * *